US006651462B2

(12) United States Patent
Okamoto

(10) Patent No.: US 6,651,462 B2
(45) Date of Patent: Nov. 25, 2003

(54) METHOD OF KNITTING NECK PORTION OF KNIT WEAR BY USING FLAT KNITTING MACHINE, AND THE KNITWEAR

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/169,562

(22) PCT Filed: Jan. 24, 2001

(86) PCT No.: PCT/JP01/00489

§ 371 (c)(1),
(2), (4) Date: Jul. 8, 2002

(87) PCT Pub. No.: WO01/55491

PCT Pub. Date: Aug. 2, 2001

(65) Prior Publication Data

US 2003/0010067 A1 Jan. 16, 2003

(30) Foreign Application Priority Data

Jan. 26, 2000 (JP) ..... 2000-017004

(51) Int. Cl.[7] ..... D04B 4/10
(52) U.S. Cl. ..... 66/64; 66/176
(58) Field of Search ..... 66/64, 176, 70, 66/169 R, 171, 170, 68, 69, 75.1

(56) References Cited

U.S. PATENT DOCUMENTS 5,826,445 A * 10/1998 Okamoto ..... 66/70
5,916,272 A * 6/1999 Nonnenmacher et al. ..... 66/69
6,138,482 A * 10/2000 Shima et al. ..... 66/69
6,286,340 B1 * 9/2001 Yui ..... 66/70

FOREIGN PATENT DOCUMENTS

| | | |
|---|---|---|
| JP | 4-214448 | 8/1992 |
| JP | 8-158209 | 6/1996 |
| JP | 10-77556 | 3/1998 |

* cited by examiner

*Primary Examiner*—Danny Worrell
(74) *Attorney, Agent, or Firm*—Rothwell, Figg, Ernst & Manbeck

(57) ABSTRACT

Knitting of a neckline 10 formed in a front body 2*a* of seamlessly knitted, sleeved knitwear, such as a sweater. The knitting comprises the step that the front body 2*a* is knitted to be forked into a right front body 15*a* and a left front body 5*b;* widening stitch is formed around a margin of a front neckline 10*a* in the process of knitting the right front body 15*a* and the left front body 5*a;* stitch of the right front body 15*a* and stitch of the left front body 5*a* are shifted in a direction of being away from the neckline 10*a;* and the stitches in the region around the margin of the neckline 10*a* are sequentially slipped from the knitting to be put into inoperative positions, this knitting being repeated a predetermined number of times, so as to widen the neckline 10*a* of the front body 2*a;* and the step that the front part which was increased in number of stitches during the formation of the neckline 10 is sequentially fed from a stitch situated at an outside thereof to the second needle bed, to keep balance between the knitting width of the front part of the tubular body and the knitting width of the back part of the tubular body.

7 Claims, 12 Drawing Sheets

METHOD OF KNITTING NECK PORTION OF KNIT WEAR BY USING FLAT KNITTING MACHINE, AND THE KNITWEAR

TECHNICAL FIELD

The present invention relates to a knitting method of knitting a neckline of knitwear, such as a sweater and a cardigan, and to the knitwear knitted in the knitting method.

BACKGROUND ART

The applicant previously proposed in Japanese Laid-open (Unexamined) Patent Publication No. Hei 4-214448 a knitting method of knitting a knitted fabric by using a flat knitting machine wherein a neckline in a front body is widened and also a front drop is formed in the neckline. In this knitting method, the front body is so knitted as to be forked from a starting point for forming the neckline into a right front body and a left front body which confront each other across the neckline. In the process of the knitting, widening stitches are formed around a margin of the neckline and also the stitches of the right front body and left front body are shifted to the outside, respectively. This knitting is repeated to knit the front body from the right and left front bodies up to their shoulder portion. As a result of the neckline being formed in this manner, the number of wale of the neckline is increased and, as a result of this, not only a collar knitted subsequent thereto is widened but also the front drop is automatically formed in the neckline. When the front body thus knitted is used to produce a sweater, the knitwear comes to be fancy and stylish and so comfortable to wear that when wearing, one's head can smoothly pass through the neckline.

The method of the publication cited above is directed to a knitting technology for knitting the front body singularly as a part, not to the so-called "seamless knit" that is the knitting technology in which the front body and the back body are joined at each knitting-widthwise end, to knit them into a tubular form and also are joined at their shoulder portions in the process of knitting by using the flat knitting machine, whereby knitwear, such as a vest and a sweater, is completed.

The "seamless knit" is the knitting technology for simplifying or omitting the sewing operation after the knitting process. The applicant has proposed in many applications a variety of knitting technologies on and in connection with the seamless knit so far, including Japanese Laid-open (Unexamined) Patent Publications No. Hei 2(1990)-91254, Hei 2(1990)-229248, Hei 4(1992)-209855 and Hei 4(1992)-153346.

In the seamless knit using a two-bed flat knitting machine, for examples, odd needles on the needle beds are used for a front part of a knitted fabric, such as a front body and front sleeve parts; even needles are used for a back part of the knitted fabric; and alternate needles on the front and back needle beds are used for the seamless knit. When the front part of the knitted fabric is knitted, the back part of the knitted fabric is retained on (associated with) the back needle bed. On the other hand, when the back part of the knitted fabric is knitted, the front part of the knitted fabric is associated with the front needle bed. Thus, the respective fabrics are knitted, with the front and back parts overlapping each other. As a result of this, the empty needles for transference can always be reserved for the respective parts of the knitted fabric on the opposed needle beds. Using the empty needles enables the knitting of the structure pattern, such as links, garter and rib, in which front stitches and back stitches are mixed, and also enables the stitches of the sleeves and bodies to be shifted laterally so as to be joined to each other. In contrast to this, in the seamless knit using a four-bed flat knitting machine, for example, the needles on the lower front needle bed and the upper back needle bed are used to knit the front part of the knitted fabric, and the needles on the lower back needle bed and the needles on the upper front needle bed are used to knit the back part of the knitted fabric. In the seamless knit using the four-bed flat knitting machine, when the front part of the knitted fabric is knitted, the back part of the knitted fabric is associated with the lower back needle bed. On the other hand, when the back part of the knitted fabric is knitted, the front part of the knitted fabric is associated with the lower front needle bed. As a result of this, the seamless knit using the four-bed flat knitting machine does not have the limitation that the alternate needles are used for the seamless knit, as in the seamless knit using the two-bed flat knitting machine. The seamless knit can be performed by using a flat knitting machine of a transfer jack bed type wherein transfer jacks are arranged in line over either or both of the front and back needle beds of the two-bed flat knitting machine.

On the other hand, the stitch loop holding technique disclosed by Japanese Laid-open (Unexamined) Patent Publication No. Hei 11(1999)-43849, which is called "holding technique", is applicable to the seamless knit. The terminology, "holding", means the stitch loop holding technique using a kind of compound needle, which is called "slide needle", comprising a needle body and a slider which is formed by combining two thin metal sheets and has a tongue at a front end portion thereof. In the holding technique, the stitch as was originally retained on the hook of the needle body is held on the needle and also an additional stitch is received and held on the tongue of the slider, so that those two different stitches are separately held on the same needle. Reference is made to the publication mentioned above about the details of "the holding". Using this holding technique enables the needle to which the stitch is transferred to be used as the empty needle. If this holding technique is used to transfer the stitches back to the original empty needles after the knitting is adequately performed, even the two-bed flat knitting machine can knit the knitwear seamlessly with all needles, without any need for previous reservation of the empty needles for the transference of stitches.

However, the application of the knitting method of Japanese Laid-open (Unexamined) Patent Publication No. Hei 4(1992)-21448 previously cited to the knitwear to be knitted seamlessly is not easy when the knitwear is wanted to widen the neckline width and also form the front drop in the neckline portion. For example, when the knitwear is knitted in the form of a vest, consideration must be taken of not only the front body but also the relation with the back body which is integrally knitted in parallel with the front body to confront it. Further, in knitting a sweater, a cardigan or the like, since the sleeves are laid at each side of the bodies, further consideration must be taken, including the horizontal and vertical positions of those parts and the way of forming the neckline in the front body and of being integrally knitted with the other parts while transferring the neckline to the outside, thus requiring further complicated consideration and calculation.

It is the object of the present invention to provide a knitting method of knitting knitwear, such as sweater, by using the seamless knit mentioned above and of knitting the neckline of the knitwear.

DISCLOSURE OF THE INVENTION

The present invention provides a method of knitting knitwear comprising a front part having a front body and sleeves and a back part having a back body and sleeves by using a flat knitting machine comprising at least a pair of front and back needle beds, which are extended laterally and confront each other in back and front and at least either of which can be racked laterally to transfer stitches between the needles beds, wherein the knitwear is knitted in the condition that the front part of the knitwear is associated with the first needle bed and the back part of the knitwear is associated with the second needle bed, so that the body and sleeves of the front part and the body and sleeves of the back part are joined at both knitting-widthwise ends, so as to be knitted in the form of a tubular body and wherein while the bodies and the sleeves are knitted up to underarms of the knitwear and then are joined from the underarms to shoulders so as to be knitted into a tubular form, stitches of the both sleeves are shifted toward the bodies and are laid over stitches of the bodies in sequence so that the tubular body can gradually decreased in diameter and a neckline formed in the front body is formed in the following steps:

1) the step that the knitting that the front body forming the front part of the tubular body is knitted to be forked into a right front body and a left front body; widening stitch is formed around a margin of the neckline of the front body in the process of knitting the right front body and the left front body; stitch of the right front body and stitch of the left front body are shifted in a direction of being away from the neckline; and the stitches in the region around the margin of the neckline are sequentially slipped from the knitting to be put into inoperative positions is repeated a predetermined number of times, so as to widen the neckline of the front body; and
2) the step that when either of right-side and left-side of the front part is knitted in the step 1, the course knitting is performed in the condition that the stitch of the other side of the front part at a knitting-widthwise side end thereof is fed to the second needle bed, while on the other hand, when the other side of the front part is knitted, the course knitting is performed in the condition that the stitch of the one side of the front part at a knitting-widthwise side end thereof is fed to the second needle bed and also the stitch of the other side of the front part that was fed to the second needle bed is fed back to the first needle bed, so that even when the widening stitch causes the front part to be larger in knitting width than the back part, stitch is increased around a margin of the neckline formed in, the front body of the tubular body, while balancing the number of stitches of the knitted fabric retained on the front needle bed and the number of stitches of the knitted fabric retained on the back needle bed.

It is preferable that the knitwear knitted is a sweater of a set-in type and the stitches of the front body are fed to the second needle bed.

It is particularly preferable that the knitwear is a sweater of a set-in type having such a design that a joint portion of the front body to the back body is located in the back body beyond a shoulder line, and that when the front body is knitted to form the neckline up to the shoulder line, the front body is knitted, with widening stitch formed around the margin of the neckline of the front body, and is shifted to and joined to the front sleeve part and, thereafter, when a part of the front body extending over the shoulder line toward the back body is knitted, the part of the front body is knitted, with the widening stitch continuously formed around the margin of the neckline, and is shifted to and joined to the back sleeve part.

Particularly, the knitting method mentioned above comprises the following steps:

(1) the step that when the neckline is formed, stitch of the back sleeve part of one of the sleeves is transferred to the first needle bed and also stitch of the front sleeve part of the other sleeve is transferred to the back needle bed;
(2) the step that the front body adjacent to the sleeve as was shifted to the first needle bed in the step 1 is knitted to form one of the front necklines and the front body is sequentially shifted toward the adjacent sleeve during the formation of the neckline;
(3) the step that the stitch of the other sleeve retained on the second needle bed is shifted to the first needle bed and the stitch of the front body at a side end thereof on the side on which the neckline was formed is fed to the back needle bed; and
(4) the step that the front body adjacent to the other sleeve shifted to the first needle bed in the step (3) is knitted to form the neckline, and the front body thus knitted is sequentially shifted to and joined to the adjacent sleeve during the formation of the neckline.

Also, it is preferable that the knitwear is a sweater of a raglan type and stitches of the sleeves are sequentially fed to the second needle bed.

It is particularly preferable that the neckline is formed in the process of repeatedly knitting shuttlewise between a left front body, a left sleeve, a back body, a right sleeve and a right front body, that when the front body is knitted, the stitch is increased around the margin of the neckline and also the front body and the adjacent front sleeve part are both shifted to outside, and that following steps are taken to widen a left part of the neckline:

a) the step of racking the second needle bed leftwards; and
b) the step of feeding the stitch of the left front sleeve to the second needle bed; and
c) the step of feeding the stitch of the right front sleeve back to the first needle bed, and wherein the following steps are taken to widen a right part of the neckline:

d) the step of racking the second needle bed rightwards;
e) the step of feeding stitch of the right front sleeve to the second needle bed; and
f) the step of feeding the stitch of the left front sleeve back to the first needle bed.

The present invention provides seamless knitwear with sleeves whose front and back bodies and front and back sleeve parts are joined at each knitting-widthwise end thereof so that they are knitted into a tubular body and also the sleeves and the bodies are joined from underarms to shoulders are knitted by using a flat knitting machine, wherein a front neckline formed in the front body is formed to have a front drop by performing a widening-stitch knitting and a flechage knitting, and also is formed to have more number of stitches than the back neckline.

Operation of the present invention will be described below.

While the bodies and the both sleeves are knitted up to underarms of the knitwear and then are joined from the underarms to shoulders so as to be knitted into a tubular form, stitches of the both sleeves are shifted toward the bodies and are laid over stitches of the bodies in sequence so that the tubular body can gradually decreased in diameter. In parallel with this knitting process, the front body is forked into the right front body and the left front body, so that the front neckline is formed in therebetween. The front neckline is increased in the number of wale forming the neckline in such a manner that widening stitch is formed around the margin of the front neckline and also stitch of the right front body and stitch of the left front body are shifted in a direction of being away from the neckline. As a result of this, the width of the collar subsequently knitted can be widened. Also, when the stitch of the right front body and the stitch of the left front body are shifted in the direction of being away from the neckline, the widening stitch is formed around the margin of the neckline. As a result of this, no hole is provided at the joint of the neckline. Also, in parallel with the knitting mentioned above, the knitting that the stitches in the region around the margin of the neckline are sequentially put into inoperative positions is repeated a predetermined number of times. As a result of this, the front drop is automatically formed in the neckline.

Further, the front part in which the neckline was increased in number of stitches is sequentially fed from a stitch situated at the outside of the sleeve or body to the second needle bed, to prevent difference in number of stitches between the front part of the knitted fabric retained on the first needle bed and the back part of the knitted fabric retained on the second needle bed, so as to balance the number of stitches of the fabric retained on the front needle bed and the number of stitches of the fabric retained on the back needle bed. Thus, the stitches in the boundary therebetween are kept in the positions close to each other, without being away from each other. As a result of this, the tubular body can be knitted without occurrence of yarn rupture.

In the case that the knitwear is a sweater of a set-in type, the stitch of the front body is fed to the second needle bed. It should be noted here that the stitch of the front body include the stitch of the neckline formed in the front body, the stitch of the front body adjacent to the neckline, and the stitch of both of them. As a result of the stitch of the front body being fed to the back needle bed in this manner, the front and back parts can be made to have a uniform knitting width before the knitting of the collar and, as a result of this, the fabric can be knitted in tubular form at the collar without any difficulty.

In the case of a sweater of a set-in type having such a design that the joint portion of the front body to the back body is located in the back body beyond the shoulder line, in particular, the course knitting of the front body only is performed in the first half in which the knitting width of the neckline to the shoulder line is increased. In the first half, widening stitch is formed around the margin of the neckline of the front body and also the front body is shifted to and joined to the front sleeve part. Then, in the second half in which a part of the front body is extended over the shoulder line toward the back body, the widening stitch is continuously formed around the margin of the neckline and also the front body is shifted to and joined to the back sleeve part.

Specifically, when the neckline is formed, the stitch of the back sleeve part of one of the sleeves is shifted to the first needle bed and also the stitch of the front sleeve part of the other sleeve is fed to the back needle bed, so that the stitches in the boundary of the knitted fabrics of the tubular body retained on the front and back needle beds are prevented from being away from each other to a large extent. Then, while the front body adjacent to the sleeve as was shifted to the first needle bed is knitted in this state, one of the front necklines is formed and also the front body is joined to the sleeve adjacent to the front body. Then, as is the case with the above, the stitch of the other sleeve retained on the second needle bed is shifted to the first needle bed, so that the stitches in the boundary of the knitted fabrics retained on the front and back needle beds are prevented from being away from each other to a large extent, while also, the stitch of the front body at a side end thereof on the side on which the neckline was formed is fed to the back needle bed, so that the forming of the other neckline and the joining of the front body and the sleeve are simultaneously performed. As a result of the stitch of the sleeve on the side on which the neckline is formed being shifted to the front needle bed in this manner, the front body can be kept in its fixed state on the front needle bed, thus facilitating the course knitting of the front body.

In the case that the knitwear is a sweater of a raglan type, stitches of the sleeves are sequentially fed to the second needle bed to balance the front and back parts of the tubular body. Specifically, the neckline is formed in the process of knitting shuttlewise between a left front body, a left sleeve, a back body, a right sleeve and a right front body. When the front body is knitted, the stitch is increased around the margin of the neckline and also the front body and the adjacent front sleeve part are both shifted to the outside. When the left part and the right part of the neckline formed in the front body retained on the first needle bed are alternately widened, the following steps are taken. When the left part of the neckline is widened: after the second needle bed is racked leftwards, the stitch of the left front sleeve is fed to the second needle bed and the stitch of the right front sleeve is fed back to the first needle bed. On the other hand, when the right part of the neckline is widened: after the second needle bed is racked rightwards, the stitch of the right front sleeve is fed to the second needle bed and the stitch of the left front sleeve is fed back to the first needle bed. As a result of this, the stitches in the boundary can be kept in the positions close to each other, without being away from each other between the front and back needle beds. As a result of this, the neckline can be knitted while keeping the tubular body.

In addition, in the knitwear of the present invention, since the front neckline formed in the front body is increased in number of wale by the widening-stitch knitting and also the front drop is formed by the flechage knitting, the collar knitted continuously to the front neckline can be formed to have a wider collar than the usual collar, thus producing the knitwear of stylish and so comfortable to wear that when wearing, one's head can smoothly pass through the neckline.

BEST MODE FOR CARRYING OUT THE INVENTION

In the following, certain preferred embodiments of the present invention will be described in detail with reference to the accompanying drawings.

In the illustrated embodiments, a flat knitting machine having front and back needle beds, which have a number of knitting needles arranged in line, which confront each other in front and back, with the back needle bed being capable of being racked laterally, and between which stitch is transferred, is used, though not shown.

Embodiment 1

Figure 1:
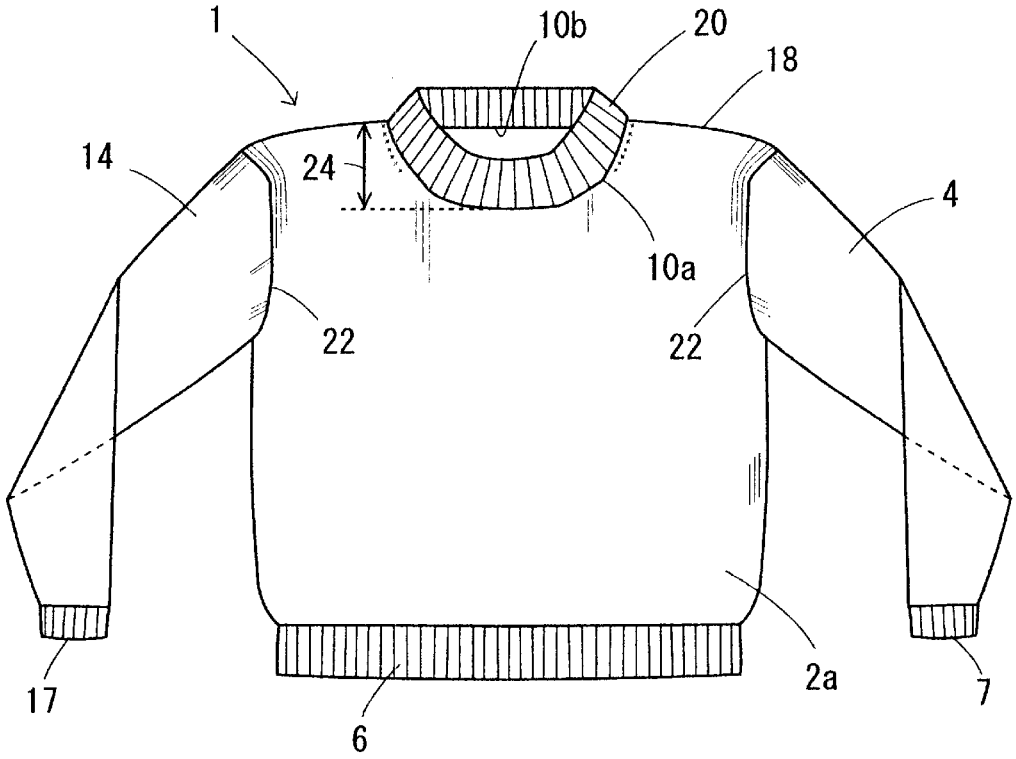
FIG. 1 shows a round-necked, set-in sweater knitted in the embodiment 1.
Figure 2:
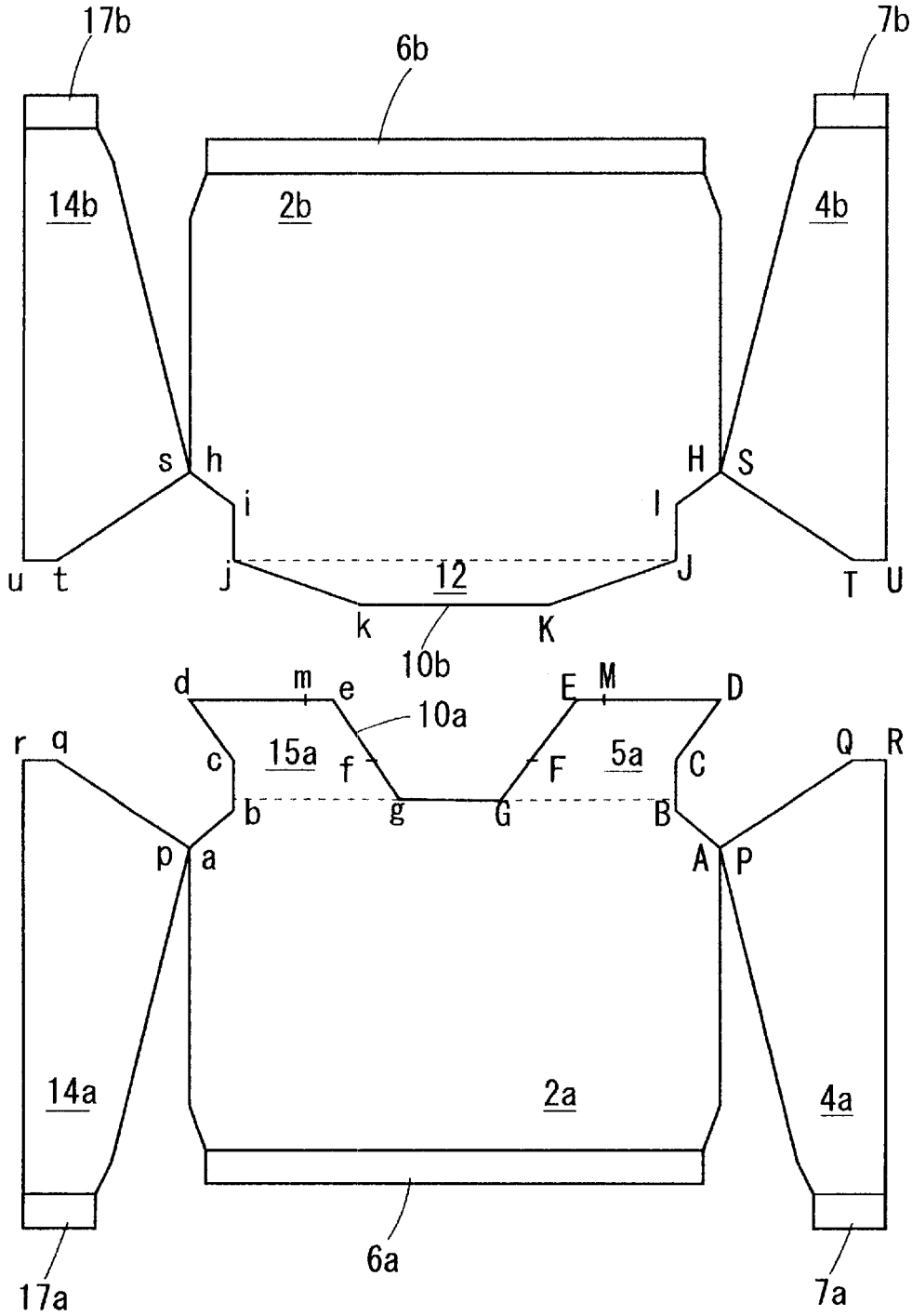
FIG. 2 shows parts of the sweater that are to be knitted on a flat knitting machine.
Figure 3:
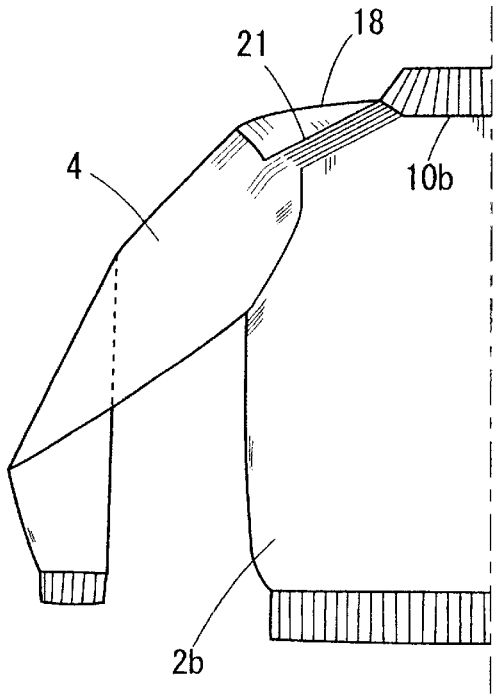
FIG. 3 shows a left half of the sweater as viewed from the back.
Figure 4:
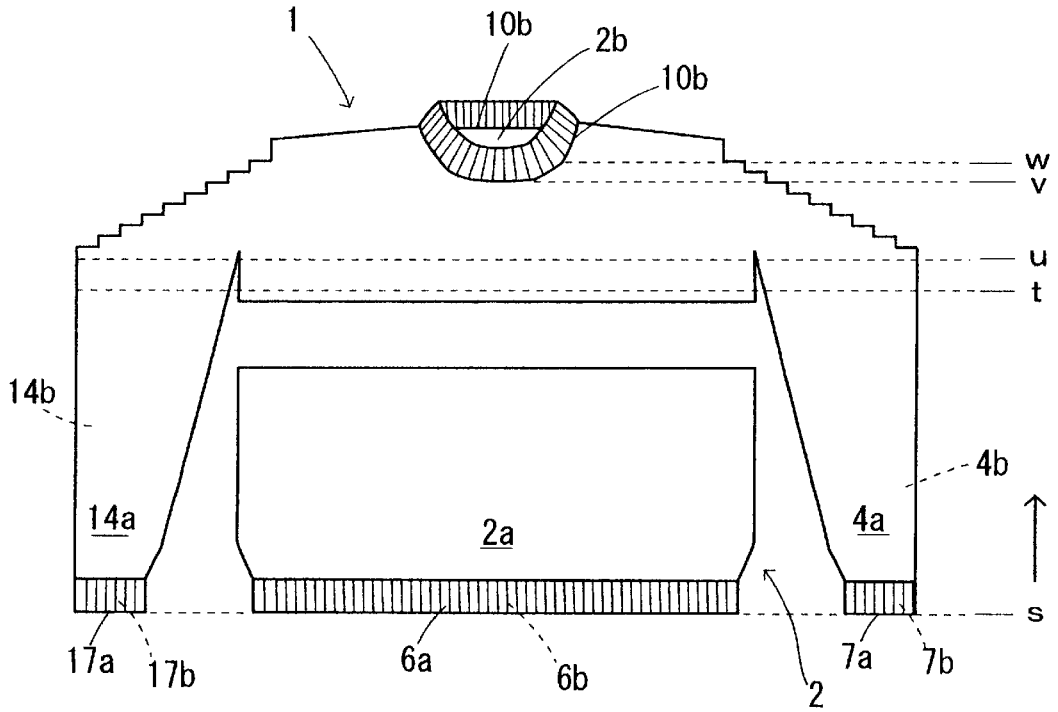
FIG. 4 shows an outline of the knitting of the sweater in the respective steps.
Figure 5:
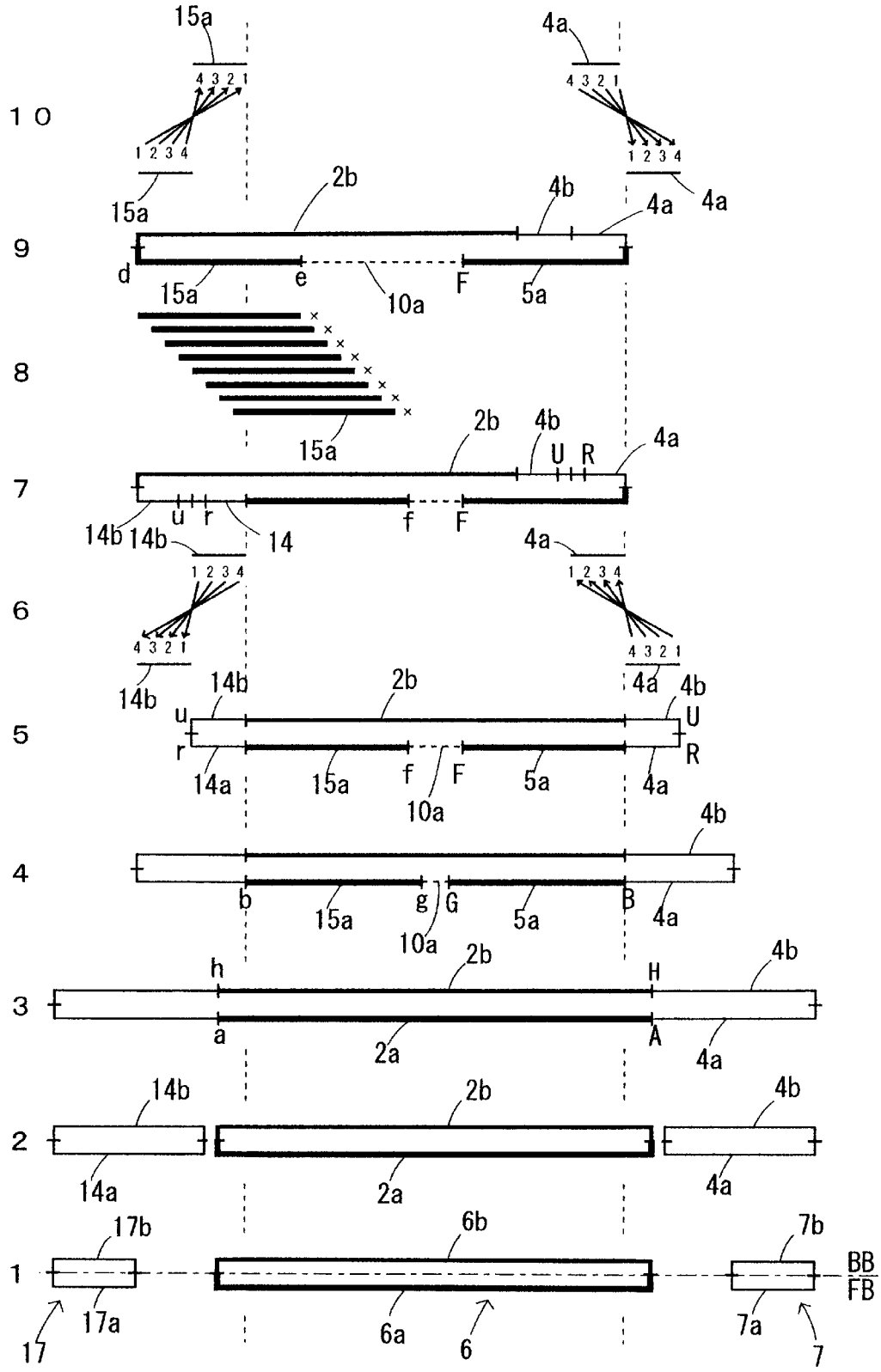
FIG. 5 shows a first half of the knitting steps of the sweater.
Figure 6:
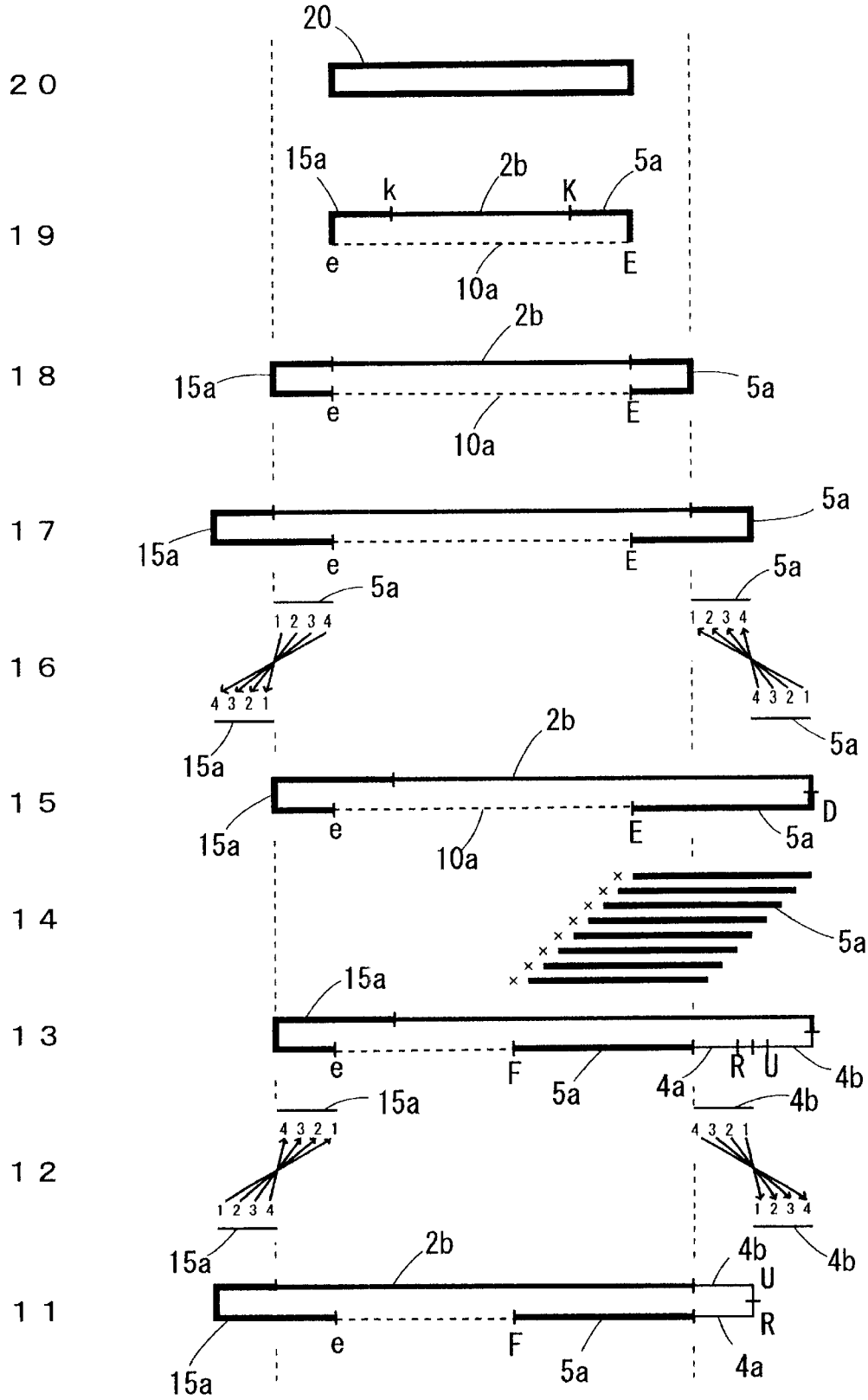
FIG. 6 shows a second half of the knitting steps of the sweater.

FIG. 1 shows a set-in sweater 1 knitted as knitwear in this embodiment. FIG. 2 shows a pattern paper (stitch alignment) of bodies and sleeves of the sweater. Illustrated above is the pattern of a back body 2*b* and back sleeve parts 4*b,* 14*b* which will appear at the back side when wearing the sweater. These parts are knitted with needles on the back needle bed. Illustrated below is the pattern of a front body 2*a* and front sleeve parts 4*a,* 14*a* which will appear at the front side when wearing the sweater. These parts are knitted with needles on the front needle bed. FIG. 3 shows the left half of the sweater 1 as viewed from the back. FIG. 4 shows an outline of the knitting of the sweater 1 in the respective steps. The knitting proceeds in the direction indicated by an arrow, beginning at S. FIGS. 5 and 6 show the knitting steps, illustrating the knitting in each step of FIG. 4 in detail. In these diagrams, the front body is represented by a boldest solid line; the back body is represented by a second-boldest solid line; and the sleeve is represented in a solid line. The sweater 1 knitted in this embodiment is a rounded-neck sweater which has the courses formed from the hem of the front body to the point D larger in number than the courses formed from the hem of the back body to the point J and is designed so that the front body goes beyond a shoulder line 18 into the back body and is joined to the back body thereat. For convenience of explanation, the sweater is designed in the form of an unpatterned plain knit, though it may have a structure pattern such as jacquard or rib.

In the sweater 1, the front body 2*a* and the front sleeve parts 4*a,* 14*a* are joined at the underarms A, a and P, p of the front body and the front sleeve parts, and the back body 2*b* and the back sleeve parts 4*b,* 14*b* are joined at the underarms H, h and S, s of the back body and the back sleeve parts. The line A-B-C of the front body 2*a* and the line P-Q of the sleeve 4*a* are joined around the armhole 22, and the line a-b-c of the front body 2*a* and the line p-q of the sleeve 14*b* line are joined around the armhole 22. Likewise, the line H-I-J of the back body 2*b* and the line S-T of the sleeve 4*b* are joined, and the line h-i-j of the back body 2*b* and the line s-t of the sleeve 14*b* are joined. The front body 2*a* is different from the back body 2*b* in the shape subsequent to the points G, g of the neckline 10*a* and is knitted to be forked into the right front body 15*a* and the left front body 5*b*. The line Q-R of the left front sleeve 4*a* is joined to the line C-D of the left front body 5*a,* first, and, then, the line U-T of the left back sleeve 4*b* is joined to the front body. Likewise, the line q-r of the right front sleeve 14*a* is joined to the line c-d of the right front body 15*a,* first, and, then, the line u-t of the right back sleeve 14*b* is joined to the front body. The front body 2*a* and the back body 2*b* are joined at the shoulder along their respective lines D-M and L-K, and d-m and j-k. Then, a collar 20 is knitted around an annulus formed by the line e-f-g-G-F-E-M-K-k-m-e, as mentioned later. It is to be noted that the terms "right" and "left" appearing in the members, such as the right front body and the left sleeve, is intended to mean the right-hand part and the left-hand part when viewing from the a wearer who wears the sweater.

Then, reference will be made to the knitting steps of FIG. 5. In the step 1, after yarns are fed to needles of a front needle bed FB by yarn feeders (not shown) prepared for the body 2 and the sleeves 4, 14, respectively, the yarn feeders are reversed in direction to feed the yarns to needles of a back needle bed BB. This knitting is repeated to start knitting rib portions 6, 7, 17 of a tubular body. In the step 2, the sleeves 4, 14 are knitted up to the underarms (at A, P, a, p, S, H, s, h) in parallel with the knitting of the body 2, while increasing the diameters of the sleeves 4, 14.

In the next step 3, the body 2 and the sleeves 4, 14 are united into a single tubular body at the underarms. This knitting is performed by using the same yarn feeders that have been used, for example, for the knitting of the body. In the steps 3–5, the tubular body and the sleeves are knitted in a course knitting ratio of e.g. 3:1. Whenever this knitting is performed, the stitches of the sleeves 4, 14 are shifted toward and laid over the stitches of the body 2. This knitting is repeated to gradually reduce the diameter of the tubular body. In these steps, the knitting width of the body is also reduced. Shown in the step 4 are the knitted fabrics retained on the needle beds when the front body 2*a* has been knitted up to the positions G, g at which the formation of the neckline 10*a* is started. From those points, the front body 2*a* is forked into a right front body 15*a* and a left front body 5*a* and is knitted in the order of the right front body 15*a,* the right sleeve 14, the back body 2*b,* the left sleeve 4 and the left front body 5*a* till the next step 5. Thereafter, the yarn feeders are reversed in direction at the neckline 10*a* (G, F, g, f) to proceed with the knitting of the front body in the inverse order of the left front body 5*a,* the left sleeve 4, the back body 2*b,* the right sleeve 14 and the right front body 15*a* as if the alphabetic character "C" is drawn. This knitting is repeatedly performed. In the knitting steps 4, 5, the so-called flechage knitting is performed, so that the stitches around the margin of the neckline 10*a* are sequentially put into inoperative positions along the lines G-F and g-f, to form a first part of the neckline 10*a*. The steps 1, 2, 3, 4 and 5 correspond to the step "s", "t", "u", "v" and "w" shown in FIG. 4, respectively.

Next, the knitting steps 6–20 corresponding to the knitting steps subsequent to the step "w" of FIG. 4 will be described. The knitting for increasing the knitting width of the front neckline 10*a* subsequent to F, f is started from here. This knitting is performed while the right front body 15*a* and the left front body 5*a* are knitted. In parallel with this knitting, the stitches of the front body 2*a* on the line C-D are laid over the stitches of the sleeve on the lines Q-R and U-T and also the stitches of the front body 2*a* on the line c-d are laid over the stitches of the sleeve on the lines q-r and u-t. Four stitches are lined on each of lines Q-R and U-T of the sleeve 4 and lines q-r and u-t of the sleeve 14. In the illustrated embodiment, eight stitches for each of the left side and right side of the front neckline 10*a,* or sixteen stitches (wale) in total for both sides thereof, are increased.

When the knitting width of the neckline 10*a* is increased, the four stitches of the right back sleeve 14*b* are transferred and fed to the front needle bed in the illustrated order of 1, 2, 3, 4, so as to be situated adjacent to the right front sleeve 14*a,* while the back needle bed is racked leftwards by one stitch, three stitches, five stitches and seven stitches in the step 6. In parallel with this process, the four stitches at the right end of the left front sleeve 4*a* are shifted to the back needle bed in the order of 1, 2, 3, 4, so as to be situated adjacent to the left back sleeve 4*b*. Thus, the stitches are transferred from one needle bed to the other needle bed in such a manner that the stitch alignments are counterchanged crosswise.

The step 7 shows the state presented when the step 6 is ended. In this state, all stitches of the right sleeve 14 are held at the left side of the front body 2*a* on the front needle bed, and all stitches of the left sleeve 4 are held at the right side of the back body 2*b* on the back needle bed. From this step, the knitting of the back body is temporarily suspended and the knitting of the front body only is performed.

The step 8 shows the course knitting of the right front body 15*a,* during which the right part of the neckline 10*a* is formed. In this step, whenever the right front body 15*a* is knitted in two courses, the stitches of the right front body 15*a* are shifted toward the stitches of the adjacent right sleeve 14, so that the stitches of the right front body 15*a* at the left end thereof are laid over the stitches of the sleeve 14 one after another. In this step, this knitting is repeated eight times, so that the knitting width of the neckline 10*a* is increased eight stitches (wale) at the left side. Whenever the stitches of the right front body 15*a* are transferred toward the sleeve 14, widening stitches are formed around the margin of the neckline, to prevent the margin of the neckline 10*a* from being bored. Although the widening stitches can be formed by using the widening technique such as tuck and split knit, any other techniques than the widening technique mentioned above may be used, as long as it can close up the bored portion.

The step 9 shows the state in which the line c-d of the right front body 15*a* and the right sleeve 14 (lines q-r and u-t) are joined to each other while the number of wale of the right part of the neckline 10*a* is increased in the manner mentioned above. In this step, the stitches of the right front body 15*a* are retained on the place in the front needle bed where the right sleeve 14 was retained; the stitches of the front body portions 5*a,* 15*a* are retained on the front needle bed; and the stitches of the back body 2*b* and the left sleeve 4*b* are retained on the back needle bed.

The next steps 10–13 show the processes of shifting the left sleeve 4 retained on the back needle bed to the front needle bed on which the left front body 5*a* is knitted, in order to knit the left portion of the neckline 10*a*. While the back needle bed is sequentially racked rightwards, the four stitches of the left back sleeve 4*b* are transferred and fed to the front needle bed in the order of 1, 2, 3, 4, so as to be situated adjacent to the left front body 5*a*. At the same time, the four stitches at the left end of the right front body 15*a* that was shifted to the place where the right sleeve 14 was originally positioned are transferred to the back needle bed one by one in the order of 1, 2, 3, 4, so as to be situated adjacent to the back body 2*b*. The step 11 shows the state in which the left front sleeve 4*a* was shifted to the front needle bed. The step 12 shows the shift of the remaining part of the left back sleeve 4*b*. The step 13 shows the state in which the whole left sleeve 4 was shifted to the front needle bed.

In the step 14, the left part of the neckline 10*a* is formed while the course knitting of the left front body 5*a* is performed. This knitting is performed in the same manner as the knitting of the right part of the neckline 10*a* as illustrated in the step 8. In this knitting step, while the knitting width of the neckline 10*a* is increased eight wale at the right side, the line C-D of the left front body 5*a* and the left sleeve 4 (lines Q-R and U-T) are joined to each other. The step 15 shows the state presented when this joining is completed.

The next step 16 shows the state in which the front body 2*a* and back body 2*b* retained on the needle beds are shifted back to their original confronting position as shown in the step 5 from the position of the step 15. The step 17 shows the state presented when the shift is ended. The knitting width of the neckline 10*a* is widened eight stitches for each side from F, f, from which it is understood that the four stitches at the outer ends of the front body portions 5*a,* 15*a* are fed to and retained on the back needle bed. Thus, although the increase in knitting width in the front part causes difference in knitting width between the front part of the tubular body and the back part of the same, since the stitches at the side end of the front body are fed to the back needle bed to balance the number of stitches of the fabric retained on the front needle bed and the number of stitches of the fabric retained on the back needle bed, the stitches in the boundary therebetween are kept in the positions close to each other, without being away from each other. As a result of this, the tubular body can be knitted without occurrence of yarn rupture.

Figure 7:
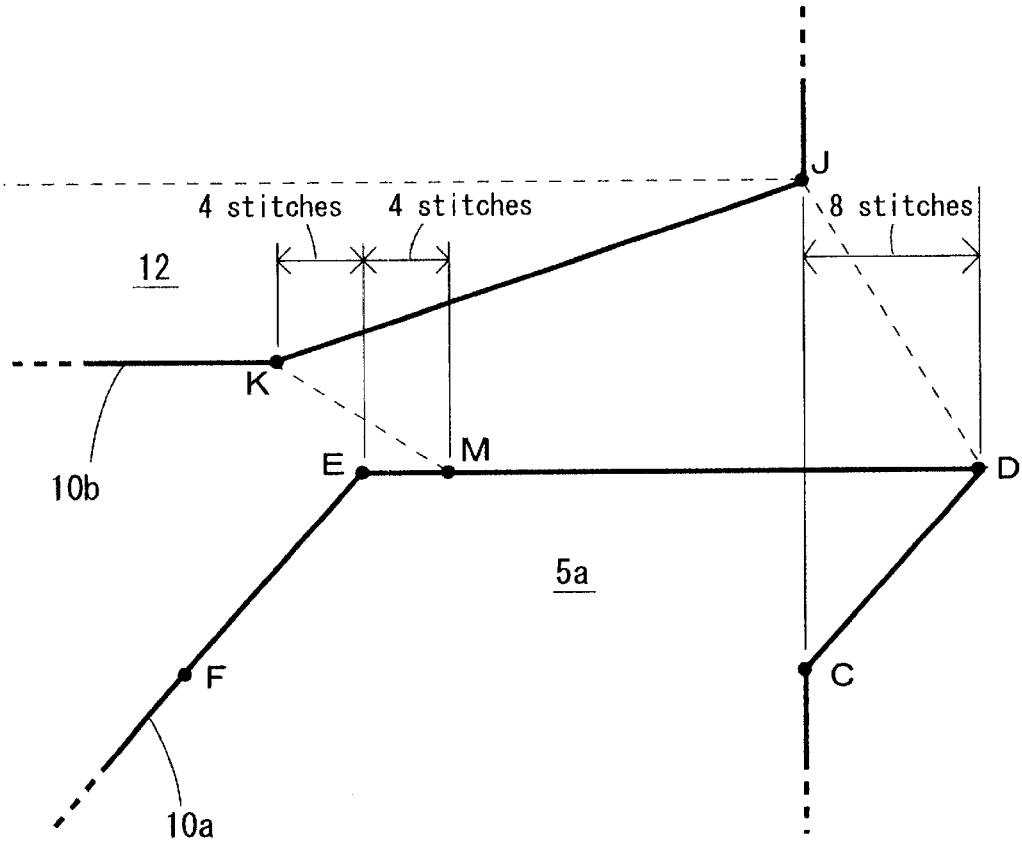
FIG. 7 schematically shows a joining relation between a shoulder portion and a left front body.

Next, reference will be made to the knitting in the steps 18–19. In these steps, the temporarily suspended course knitting of the back body 2*b* starts again and the course knitting of the shoulder portion of the back body 2*b* indicated by 12 in FIG. 2 is performed. While the knitting of the shoulder portion 12 is performed, the front body 2*a* and the back body 2*b* are joined to each other. FIG. 7 schematically shows the joining relation between the shoulder portion 12 and the left front body 5*a*. Every time when the shoulder portion 12 is knitted in a predetermined number of courses, the stitches at the side ends of the shoulder portion 12 and the stitches of the adjacent front body portions 5*a,* 15*a* are overlaid with each other one by one along the joining lines 21 to gradually reduce the knitting width of the front body and that of the back body, so as to reduce the diameter of the tubular body at the shoulder portion (joining of the line J-K of the shoulder portion 12 and the line D-M of the left front body 5*a* in FIG. 7). As this knitting proceeds, a bordered line between the front body portions 5*a,* 15*a* and the shoulder portion 12 of the back body 2*b* which are retained on the back needle bed gradually comes close to the center of the knitted fabric. In sync with this, the stitches at the side end of the front body portions 5*a,* 15*a* are sequentially fed to the back needle bed. The step 18 shows the state in which the diameter of the tubular body is partly reduced.

The step 19 shows the state presented when the knitting proceeds further and the joining of the shoulder portion is ended. In this state, only the front neckline 10*a* is retained on the front needle bed, while on the other hand, the back neckline 10*b* and the front body portions 5*a,* 15*a* are retained on the back needle bed in the state in which the four stitches on the line M-E shown in FIG. 7 of the front body portions 5*a,* 15*a* which were situated adjacent to the front neckline 10*a* on the front needle bed are sequentially fed from the M side to the back needle bed, so that the stitch alignments are counterchanged crosswise. In the step 20, the collar 20 is knitted and then the knitting of the sweater 1 is ended.

In this embodiment, the knitwear is so designed that the points K, k of the back body 2*b* are in an intermediate position between the points F and E of the front body 2*a* and in an intermediate position between the points f and e of the front body 2*a* with respect to the knitting width, respectively. With this design, the stitches on the line M-E and the stitches on the line m-e are fed to the back needle bed, as mentioned above. If it is so designed that the points K, k of the back body 2*b* correspond in position to the points F, f of the front body 2*a,* the lines D-E and d-e of the front body and the lines J-K and j-k of the back body will be joined at the shoulder portion and the four stitches on the nearside of the points E, e on the lines F-E and m-e will be fed to the back needle bed.

As mentioned above, as the result of stitch being increased when the front neckline 10*a* is formed, the knitting width of the front neckline 10*a* comes to be larger than that of the back neckline 10*b,* then causing difference in knitting width between the front and back parts. However, since the stitches of the front body adjacent to the front neckline 10*a* are fed to the back needle bed so that the front and back parts can be made to have a uniform knitting width before the knitting of the collar 20, the fabric can be knitted in tubular form at the collar without any difficulty. The sweater 1 knitted in this manner comes to have the front drop (24 in FIG. 1) formed in the neckline 10, resulting in being stylish. Besides, it comes to have a largely opened neckline so that when wearing, one's head can smoothly pass through the neckline, resulting in being comfortable to wear. While in the illustrated embodiment, the collar 20 is knitted in the form of a rounded neck, it may be knitted in any desired design such as a turtle neck. Also, the neckline may be formed in U-shape.

In the illustrated embodiment, after the right back sleeve 14*b* is shifted from the state of step 5 to the state of step 7 so that all the stitches of the right sleeve 14 can be retained on the front needle bed, the neckline 10*a* at the right front body 15*a* side is entirely formed in the step 8. Likewise, after the left back sleeve 4*b* is shifted from the state of step 9 to the state of step 13 so that all the stitches of the right sleeve 14 can be retained on the front needle bed, the neckline 10*a* at the left front body 5*a* side is entirely formed in the step 14. As a substitute for this illustrated technique, alternatives may be taken. For example, with the state of step 5 kept unchanged, the widening stitches are formed in the neckline 10*a,* while the course knitting of the right front body 15*a* is performed, so that the right front body 15*a* is shifted to and joined to the right front sleeve 14*a* first, and, then, the right back sleeve 14*b* is shifted to the front needle bed. Or, in parallel with the course knitting of the right front body 15*a,* the right back sleeve 14*b* may be shifted to the front needle bed. In short, it is just required that when the formation of the neckline 10*a* has been completed, the front body and the sleeves are in the joined state. The embodiment illustrated above is particularly advantageous in that when the neckline is formed, the stitches of the sleeves to be laid over the front body are shifted to the front needle bed, so that the course knitting of the front body can be performed in the condition that the front body is fixed on the front needle bed. This can produce the advantage of facilitating the making of the stitches.

Embodiment 2

Figure 8:
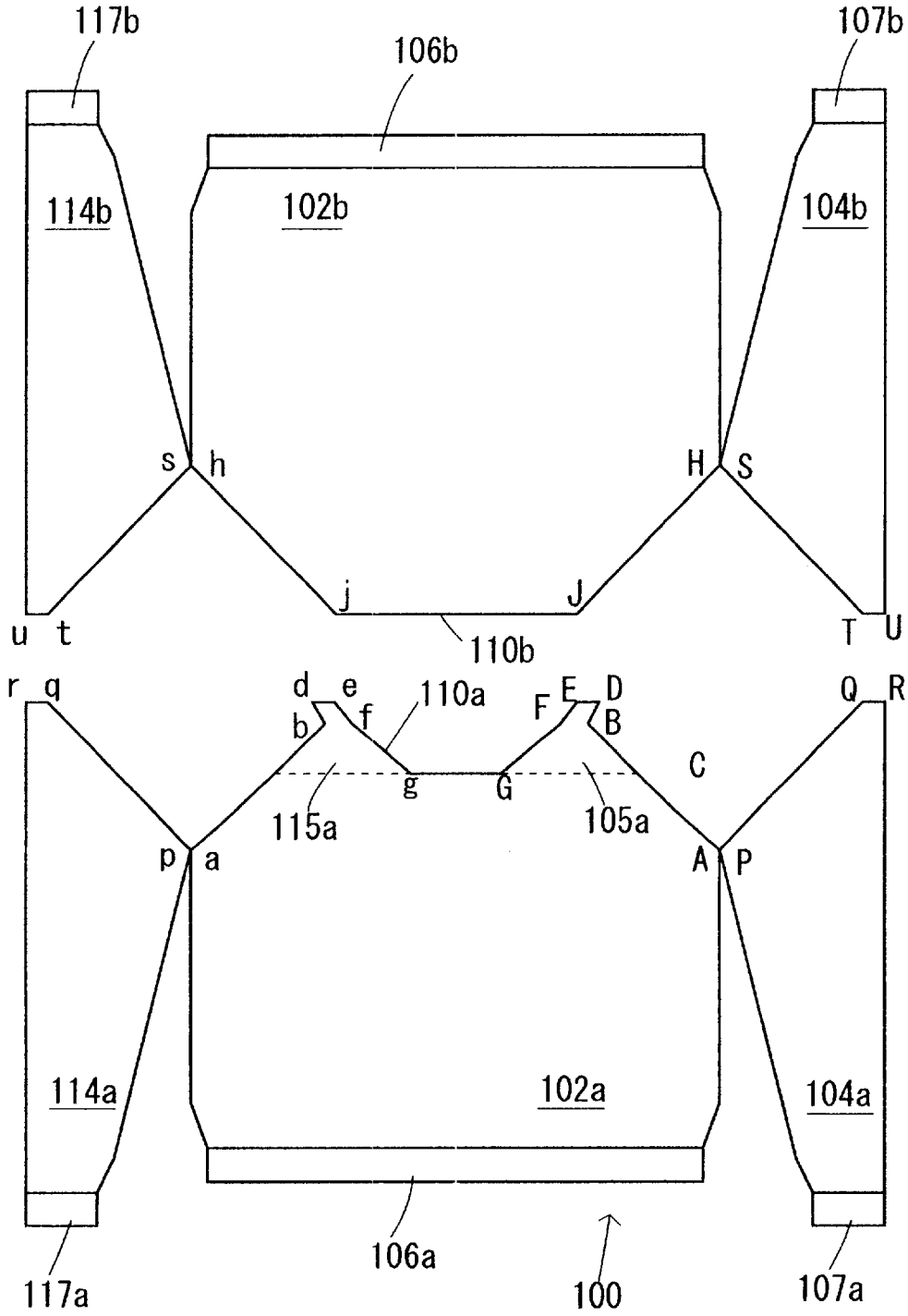
FIG. 8 shows parts of a raglan sweater that are to be knitted on the flat knitting machine in the embodiment 2.
Figure 9:
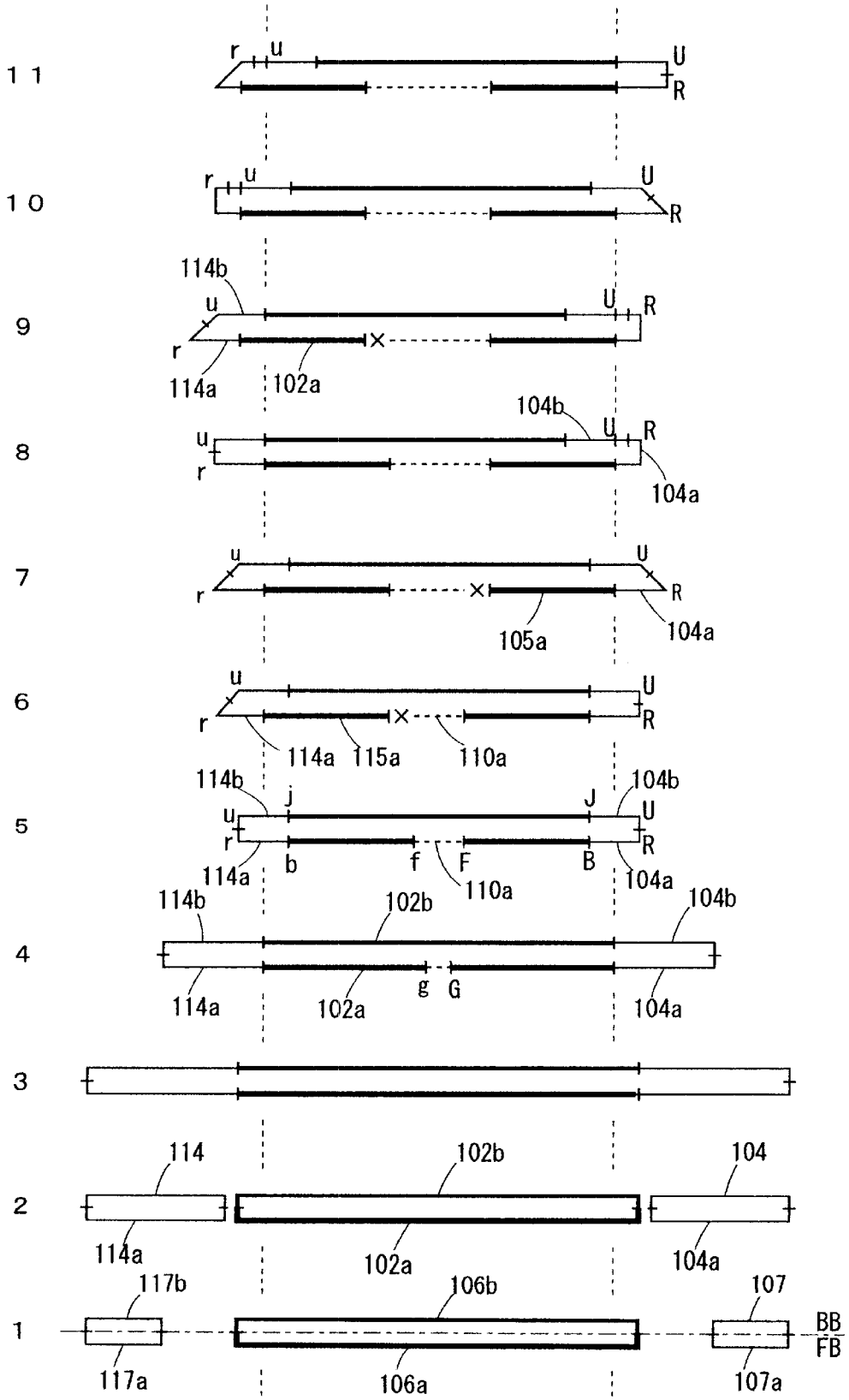
FIG. 9 shows the first half of the knitting steps of the sweater.
Figure 10:
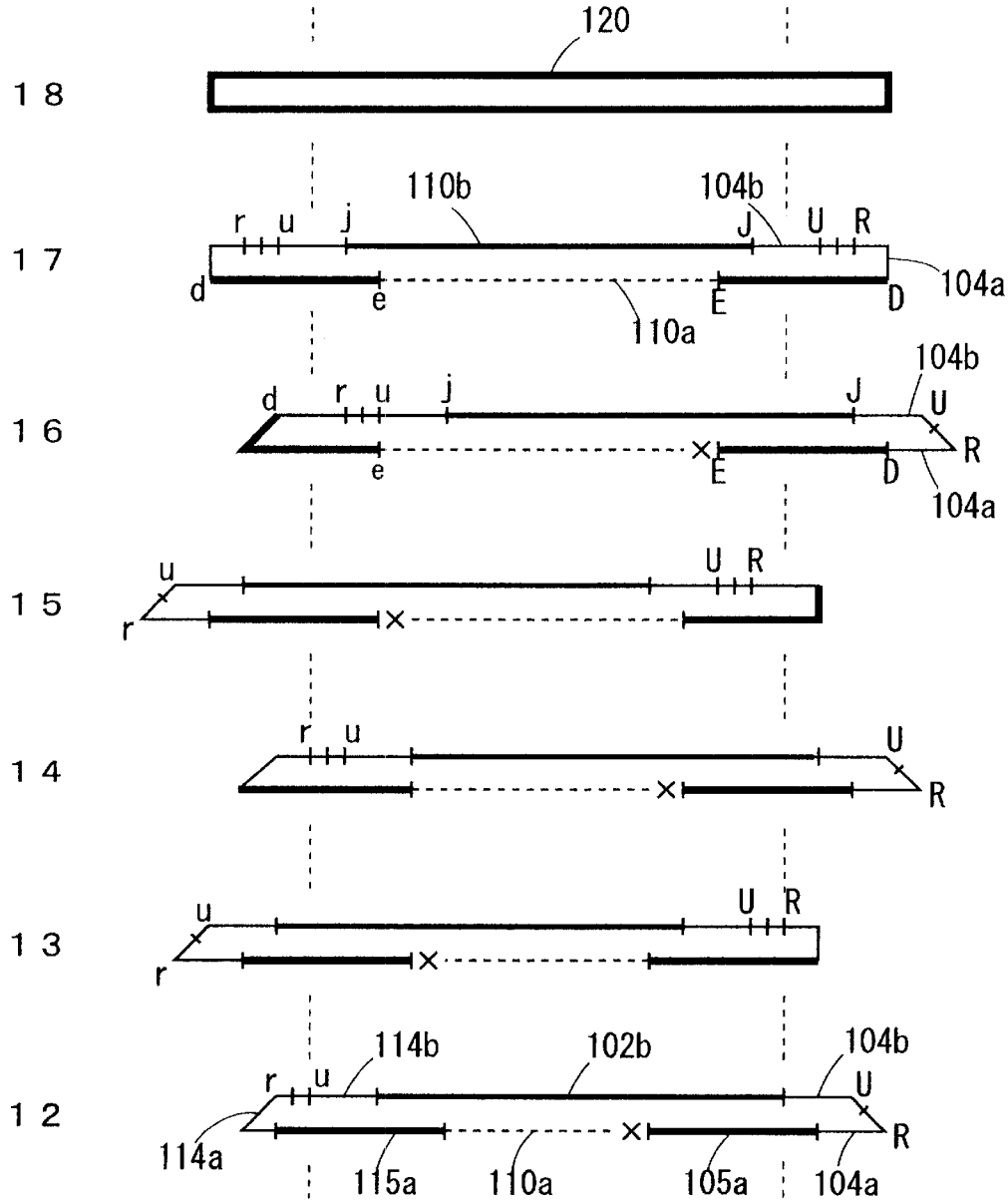
FIG. 10 shows the second half of the knitting steps of the sweater.

Next, the embodiment for knitting a raglan sweater will be described. In this embodiment, the knitting width of a front neckline 110*a* is increased eight stitches (wale) in total, four stitches for each lateral side thereof. FIG. 8 shows a pattern paper of bodies and sleeves of the raglan sweater 100. FIGS. 9 and 10 show the knitting steps in the stages corresponding to the knitting steps of the embodiment 1 of FIGS. 5 and 6.

The knitting of the steps 1 to 5 is performed in basically the same manner as in the embodiment 1. Specifically, the step 1 shows the knitting of ribs 106 of a body 102 and ribs 107, 117 of sleeves 104, 114. The step 2 shows the knitting of the sleeves 104, 114 and the body 102 in mid course toward the underarms. The step 3 shows the state in which the body 102 and the sleeves 104, 114 are joined at the underarms and formed into a large tubular body. The step 4 shows the state in which the tubular body is reduced in diameter while it is knitted up to the forming points G, g of the front neckline 110*a*. The step 5 shows the state in which the neckline 110*a* is knitted up to the points F, f.

In the case of a raglan sweater 100, the course knitting of the body and sleeves continues to the shoulder portion even after the step 5 in which the front body 102*a* is forked into a right front body 115*a* and a left front body 105*a*. Accordingly, the course knitting of the body and sleeves keeps on going that far by the yarn feeders being reversed in direction at the neckline 110*a* assumed as the boundary to shuttle between a left front body 105*a,* a left sleeve 104, a back body 102*b,* a right sleeve 114, and a right front body 115*a*.

The knitting for increasing the knitting width of the neckline 110*a* begins at the step 6. In the step 6, in the course knitting, stitch is increased around the margin of the neckline 110*a* at the right front body 115*a* side and also the right front body 115*a* and the right front sleeve 114*a* are both shifted to the outside, so that the knitting width of the neckline 110*a* is increased in a stitch at the left side thereof. Then, in the step 7, stitch is increased around the margin of the neckline 110*a* at the left front body 105*a* side and also the left front body 105*a* and the left front sleeve 104*a* are both shifted to the outside, so that the knitting width of the neckline 110*a* is increased in a stitch at the right side thereof.

The step 8 is a preparation process for effecting the course knitting to increase the knitting width of the left side of the neckline 110*a* in the next step 9. In this process, the back needle bed is racked leftwards a stitch and also the stitch at the outer end of the left front sleeve 104*a* is fed to the back needle bed. This process is the process for keeping the stitches in the boundary between the right front sleeve 114*a* and the right back sleeve 114*b* from being away from each other when the stitch is increased and the right front sleeve 114*a* and the right front sleeve 115*a* are shifted leftwards in the step 9. Hereinafter, this process is referred to as "the end alignment process". The end alignment process enables the knitting width of the front knitted fabric and the knitting width of the back knitted fabric to be balanced when difference occurs in knitting width between the front part of the tubular body and the back part of the same. As a result of this, occurrence of yarn rupture in the boundary therebetween is prevented and also yarn length extending between the stitches in the boundary is prevented from being increased excessively, thus allowing the tubular body to be continuously knitted, with hand value and feel of the knitted fabric kept in good condition. In the next step 9, the widening-stitch knitting is performed, so that the knitting width of the neckline 110*a* is further increased a stitch at the left side thereof.

The next steps 10 and 11 are the end alignment processes prepared for increasing the knitting width of the right side of the neckline 110*a* in the next step 12. Along with the racking and transference of stitch, the stitches at the side end of the right front sleeve 114*a* are fed to the back needle bed and also the stitch at the outer end of the left front sleeve 104*a* that was fed to the back needle bed in the step 8 is simultaneously fed back to the front needle bed. As for the parts that are planned to make stitches on the front needle bed, including the right front sleeve 114*a* and the left front sleeve 104*a,* the stitch course knitting is performed in the condition that those parts are fed back to the front needle bed. Likewise, as for the back parts 104*b* and 114*b,* the stitch course knitting is performed in the condition that those parts are fed back to the back needle bed, to prevent forming of twisted stitch.

Then, in the step 12, the widening-stitch knitting is performed so that the knitting width of the neckline 110*a* is further increased a stitch at the right side thereof The step 13 shows the state in which the third widening-stitch knitting is performed in the neckline at the left side thereof. The step 14 shows the state in which the third widening-stitch knitting is performed in the neckline at the right side thereof. The step 15 shows the state in which the fourth widening-stitch knitting is performed in the neckline at the left side thereof. The step 16 shows the state in which the fourth widening-stitch knitting is performed in the neckline at the right side thereof As a result of these knitting processes, the knitting width of the front neckline 110*a* is increased in four stitches for each lateral side. Though not illustrated, the end alignment process and the step for preventing occurrence of twisted stitch are inserted in between steps of the steps 13–16. In this embodiment, the knitted fabrics of the back body 102*b* and the sleeves are shifted in the condition that the knitted fabric of the front body 102*a* is fixed, to perform the end alignment process.

The step 17 shows the state in which the tubular body as was shifted rightwards to knit the neckline in the next step 18 is shifted to the center. As seen from the diagram, the front parts of the right and left sleeves 104*a,* 114*a* are in the state of being fed to the back needle bed. In the step 18, the collar is knitted, with which the knitting of the raglan sweater is ended.

Embodiment 3

Figure 11:
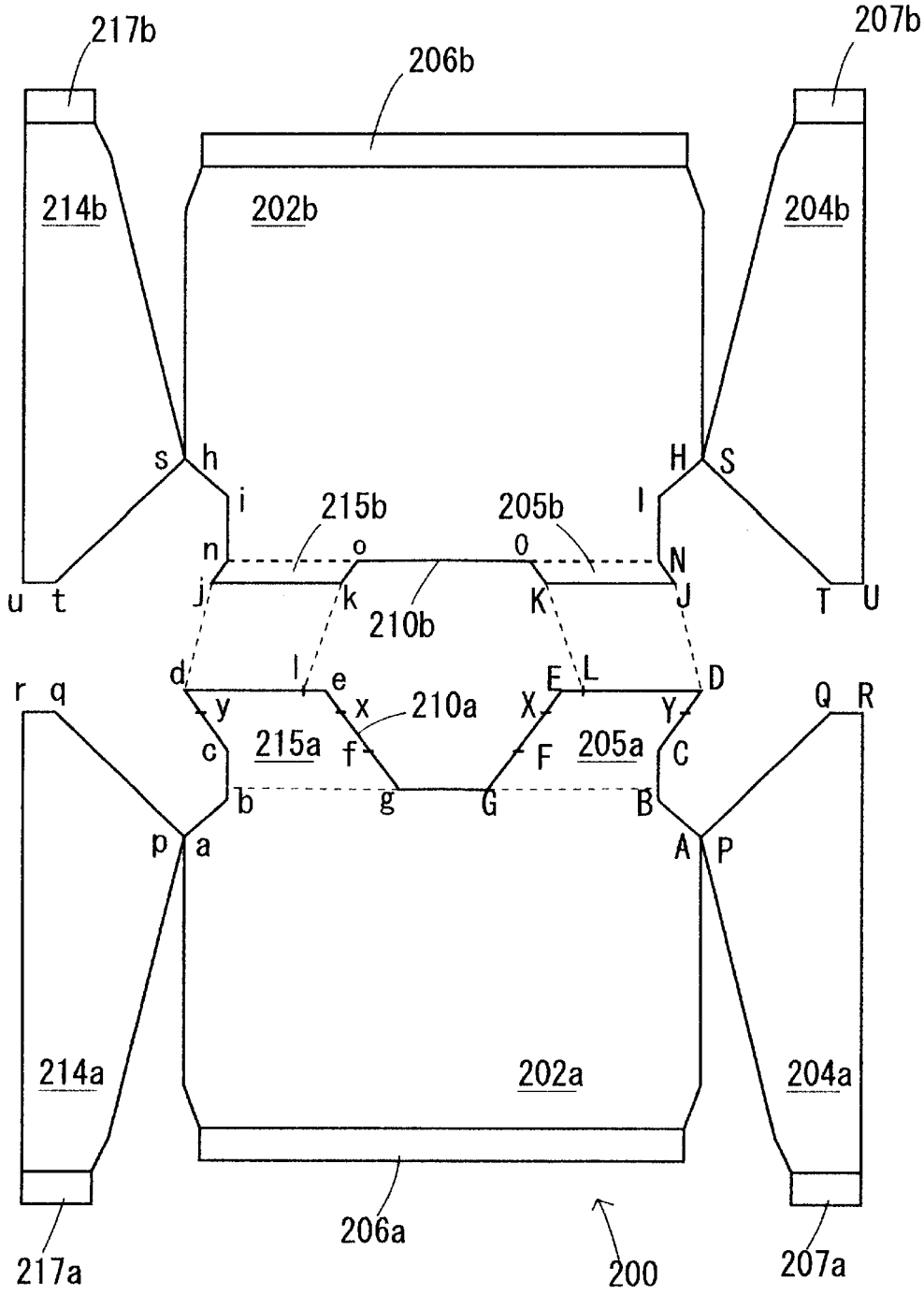
FIG. 11 shows parts of a set-in sweater that are to be knitted on the flat knitting machine in the embodiment 3.
Figure 12:
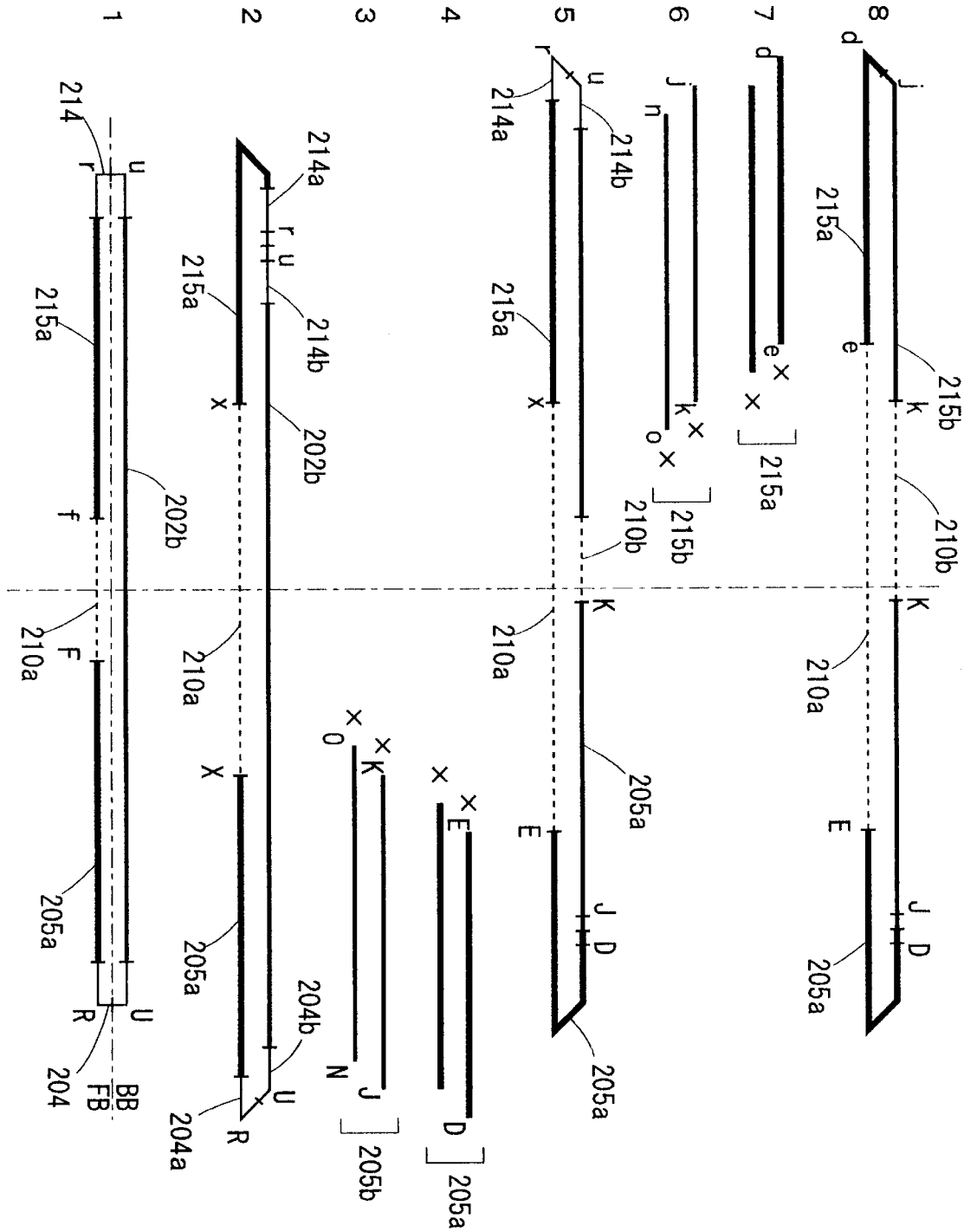
FIG. 12 shows the first half of the knitting steps in the sweater.
Figure 13:
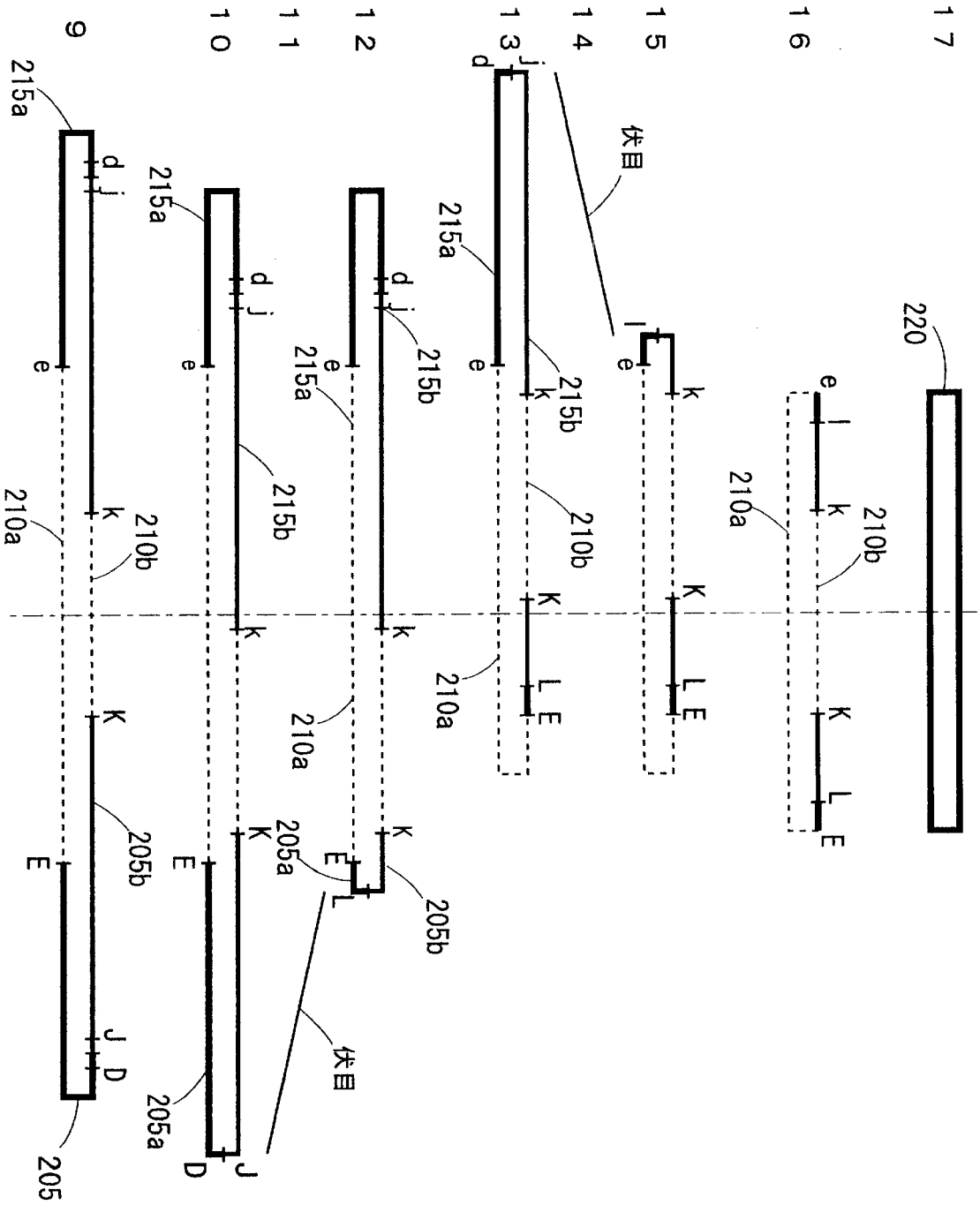
FIG. 13 shows the second half of the same.

Then, reference will be made to a variant of a set-in sweater. FIG. 11 shows a pattern paper of bodies and sleeves of a set-in sweater 200. This set-in sweater 200 is so designed that a front body and a back body are joined to each other just on a shoulder line. FIGS. 12 and 13 show the knitting steps. The step 1, which corresponds to the step 5 of the previous embodiment 1, shows the state in which a knitted fabric is retained on needle beds when a front neckline 210*a* is knitted up to the points F, f. The knitting before this stage is omitted.

The next step 2 shows the state in which the widening-stitch knitting is performed four times around the margin of the neckline 210*a* at each side of the left front body 205*a* and the right front body 215*a* in the same manner as in the raglan sweater as mentioned above, whereby the neckline 210*a* is widened four stitches for each lateral side while it is knitted up to the points X, x. During this process, the knitting proceeds in the order of the right front body 215*a,* the right sleeve 214, the back body 202*b,* the left sleeve 204 and the left front body 205*a.* Thereafter, the yarn feeder is reversed in direction at the neckline 210*a* to do the flechage knitting in which the knitting is performed in the inverse order of the left front body 205*a,* the left sleeve 204, the back body 202*b,* the right sleeve 214 and the right front body 215*a.* Subsequently, the knitting of the sleeves 204, 214 is ended and only the front body 202*a* and the back body 202*b* are knitted further. In this embodiment, the front body 202*a* is knitted further, with the yarn feeders allocated to the right front body 215*a* and the left front body 205*a,* respectively, while on the other hand, the back body 202*b* is knitted to be forked into a left back body 205*b* and a right back body 215*b,* so as to form the neckline 210*b,* as is the case with the front body. The yarn feeders are allocated to the left back body 205*b* and the right back body 215*b* for the knitting of these back bodies.

The step 3 shows the knitting of the left back body 205*b.* In this step, the knitting that widening stitches are formed around the margin of the neckline 210*b* and also the left back body 205*b* is shifted to the outside is repeated twice, so as to form two widening stitches therearound and also the stitches of the left back body 205*b* at the side end thereof are laid over the stitches of the left back body 204*b.* The step 4 shows the same knitting as the knitting of the step 3 for the left front body 205*a.* Two widening stitches are formed around the margin of the neckline 210*a* and the left front body 205*a* is shifted to and laid over the left front sleeve 204*a.* With this, the line Q-R of the left front sleeve 204*a* and the line Y-D of the left front body 205*a* are joined and also the line T-U of the left back sleeve 204*b* and the line N-J of the left back body 205*b* are joined and then the joining of the left sleeve 204 and the body is ended.

The next step 5 shows the state presented after the end alignment process for the right front body 215*a* and the right back body 215*b* to be knitted in the same manner as in the steps 3 and 4. In the steps 6 and 7, the widening stitch knitting and the shift of the body are performed, so that the line t-u of the right back sleeve 204*b* and the line n-j of the right back body 215*b* are joined and also the line q-r of the right front sleeve 204*a* and the line y-d of the right front body 215*a* are joined, with which the joining of the right sleeve 204 and the body is ended. The step 8 shows the retained state of the knitted fabric at the completion of the knitting of the step 7. In this step, only the front body and the back body are in the state of being retained on the needle beds.

The next steps 9–15 show the steps for joining the front body and the back body at the shoulder portion and for a bind-off process. In the steps 9, 10, the end alignment process is performed so that corresponding parts can confront each other, in order for the left front body 205*a* and the left back body 205*b* to be subjected to the bind-off process in the step 11. The step 9 shows the state of the end alignment process on the way and the step 10 shows the state of the end alignment process being completed. The step 11 shows the bind-off process which is performed from the shoulder to the neckline. The bind-off process itself is known and any adequate known bind-off process, such as the process described by Japanese Laid-open (Unexamined) Patent Publication No. Hei 9 (1997)-241950 may be used. The step 12 shows the state in which the bind-off process of step 11 is ended. In this step, the line D-L of the front body and the line J-K of the back body are joined at the back body side beyond the shoulder line.

In the next step 13, the end alignment process is performed for the bind-off process of the right front body 215*a* and the right back body 215*b.* In the step 14, the bind-off process of the same is performed. The step 15 shows the state in which the knitted fabric is retained on the needle beds at the completion of the bind-off process. With this, the line d-l of the front body and the line j-k of the back body are joined at the back body side beyond the shoulder line. The step 16 shows the end alignment process for the collar to be knitted in the step 17.

In this embodiment, the widening stitch is formed in the front neckline 210*a* six times at each lateral side thereof and also the widening stitch is also formed in the back neckline 210*b* twice at each lateral side thereof. As a result of this, when a collar 220 is knitted, the collar 220 can be knitted in the condition that the two stitches (lines E-L and e-l) at the side end of the front body are fed to the back needle bed. In the step 17, the knitting of the neckline 220 is performed, with which the knitting of the set-in sweater is ended.

In the set-in sweater of this embodiment, when the neckline is formed, the back body is also knitted to be forked into the right back part and the left back part, as shown in the steps 3 and 6, while also, when each part is knitted, the widening stitch knitting and the flechage knitting are performed, whereby the back neckline 210*b* is formed. As a result of this, the back neckline comes to have an increased knitting width, which however is smaller in knitting width than the front neckline 210*a,* and also the front drop is also formed, as is the case with the front- neckline 210*a*.

Capabilities of Exploitation in Industry

According to the knitting method of the present invention of knitting a neckline of knitwear, such as sweater and cardigan, and the knitwear knitted by that knitting method, knitwear of stylish and so comfortable to wear that when wearing, one's head can smoothly pass through the neckline can be seamlessly knitted.

What is claimed is:

1. A method of knitting knitwear comprising a front part having a front body and sleeves and a back part having a back body and sleeves by using a flat knitting machine comprising at least a pair of front and back needle beds, that extend laterally and confront each other in back and front and at least one of which can be racked laterally to transfer stitches between the needle beds, wherein the knitwear is knitted in the condition that the front part of the knitwear is associated with the first needle bed and the back part of the knitwear is associated with the second needle bed, so that the body and sleeves of the front part and the body and sleeves of the back part are joined at knitting-widthwise ends, so as to be knitted in the form of a tubular body and wherein while the bodies and the sleeves are knitted up to underarms of the knitwear and then are joined from the underarms to shoulders so as to be knitted into a tubular form, stitches of the both sleeves are shifted toward the bodies and are laid over stitches of the bodies in sequence so that the tubular body can gradually decrease in diameter and a neckline formed in the front body is formed in the following steps:

1) knitting the front body forming the front part of the tubular body so as to be forked into a right front body and a left front body; forming a widening stitch around a margin of the neckline of the front body in the process of knitting the right front body and the left front body; shifting a stitch of the right front body and a stitch of the left front body in a direction of being away from the neckline; and sequentially slipping stitches in the region around the margin of the neckline from the knitting to be put into inoperative positions a predetermined number of times, so as to widen the neckline of the front body; and 2) when either of right-side and left-side of the front part is knitted in the step 1, the course knitting is performed in the condition that the stitch of the other side of the front part at a knitting-widthwise side end thereof is fed to the second needle bed, while on the other hand, when the other side of the front part is knitted, the course knitting is performed in the condition that the stitch of the one side of the front part at a knitting-widthwise side end thereof is fed to the second needle bed and also the stitch of the other side of the front part that was fed to the second needle bed is fed back to the first needle bed, so that even when the widening stitch causes the front part to be larger in knitting width than the back part, the stitch is increased around a margin of the neckline formed in the front body of the tubular body, while balancing the number of stitches of the knitted fabric retained on the front needle bed and the number of stitches of the knitted fabric retained on the back needle bed.

2. The knitting method of knitting knitwear according to claim 1, wherein the knitwear knitted is a sweater of a set-in type and the stitches of the front body are fed to the second needle bed.

3. The knitting method of knitting knitwear according to claim 2, wherein the knitwear is a sweater of a set-in type having such a design that a joint portion of the front body to the back body is located in the back body beyond a shoulder line, and wherein when the front body is knitted to form the neckline up to the shoulder line, the front body is knitted, with widening stitch formed around the margin of the neckline of the front body, and is shifted to and joined to the front sleeve part and, thereafter, when a part of the front body extending over the shoulder line toward the back body is knitted, the part of the front body is knitted, with the widening stitch continuously formed around the margin of the neckline, and is shifted to and joined to the back sleeve part.

4. The knitting method according to claim 3, further comprising the following steps:

1) a step including that when the neckline is formed, stitch of the back sleeve part of one of the sleeves is transferred to the first needle bed and also stitch of the / front sleeve part of the other sleeve is transferred to the back needle bed;

2) a step including that the front body adjacent to the sleeve shifted to the first needle bed in the step 1 is knitted to form one of the front necklines and the front body is sequentially shifted toward the adjacent sleeve during the formation of the neckline;

3) a step including that the stitch of the other sleeve retained on the second needle bed is shifted to the first needle bed and the stitch of the front body at a side end thereof on the side on which the neckline was formed is fed to the back needle bed; and 4) the a step including that the front body adjacent to the other sleeve shifted to the first needle bed in the step (3) is knitted to form the neckline, and the front body thus knitted is sequentially shifted to and joined to the adjacent sleeve during the formation of the neckline.

5. The knitting method of knitting knitwear according to claim 1, wherein the knitwear is a sweater of a raglan type and wherein stitches of the sleeves are sequentially fed to the second needle bed.

6. The knitting method of knitting knitwear according to claim 5, wherein the neckline is formed in the process of repeatedly knitting shuttlewise between a left front body, a left sleeve, a back body, a right sleeve and a right front body, wherein when the front body is knitted, the stitch is increased around the margin of the neckline and also the front body and the adjacent front sleeve part are both shifted to outside, wherein the following steps are taken to widen a left part of the neckline:

a) a step of racking the second needle bed leftwards;

b) a step of feeding the stitch of the left front sleeve to the second needle bed; and c) a step of feeding the stitch of the right front sleeve back to the first needle bed, and wherein the following steps are taken to widen a right part of the neckline:

d) a step of reaching the second needle bed rightwards;

e) a step of feeding stitch of the right front sleeve to the second needle bed; and f) a step of feeding the stitch of the left front sleeve back to the first needle bed.

7. Seamless knitwear with sleeves, whose front and back bodies and front and back sleeve parts are joined at each knitting-widthwise end thereof so that they are knitted into a tubular body and the sleeves and the bodies are joined from underarms to shoulders, are knitted by using a flat knitting machine, wherein a front neckline formed in the front body knitted in the method according to claim 1 is formed to have a front drop by performing a widening stitch knitting and a flechage knitting, and also is formed to have a greater number of stitches than the back neckline.

* * * * *